US009284116B2

(12) United States Patent
Prosa

(10) Patent No.: US 9,284,116 B2
(45) Date of Patent: Mar. 15, 2016

(54) WASTE RECEPTACLE

(71) Applicant: Troy A. Prosa, Minneapolis, MN (US)

(72) Inventor: Troy A. Prosa, Minneapolis, MN (US)

( * ) Notice: Subject to any disclaimer, the term of this patent is extended or adjusted under 35 U.S.C. 154(b) by 0 days.

(21) Appl. No.: 14/292,391

(22) Filed: May 30, 2014

(65) Prior Publication Data

US 2014/0353315 A1 Dec. 4, 2014

Related U.S. Application Data

(60) Provisional application No. 61/828,926, filed on May 30, 2013.

(51) Int. Cl.
*B65D 25/14* (2006.01)
*B65F 1/14* (2006.01)

(52) U.S. Cl.
CPC ..... *B65F 1/1415* (2013.01); *B65F 1/1607* (2013.01); *B65F 1/1623* (2013.01)

(58) Field of Classification Search
CPC ..... B65F 1/06; B65F 1/068; B65F 1/1415; B65F 1/1623; B65F 1/1607; B65F 1/1436
USPC ..... 220/495.06, 495.08, 495.11, 908, 220/908.1, 252
See application file for complete search history.

(56) References Cited

U.S. PATENT DOCUMENTS

| | | | |
|---|---|---|---|
| 1,240,740 | A | 9/1917 | Levett |
| 1,899,372 | A | 2/1933 | Walter |
| 1,917,363 | A | 7/1933 | Fohn |
| D137,448 | S | 3/1944 | Deutsch |
| 2,622,956 | A | 12/1952 | White |
| 2,699,368 | A | 1/1955 | Selmer |
| 2,827,354 | A | 3/1958 | Wassell et al. |
| 2,841,458 | A | 7/1958 | Selmer |
| 2,934,390 | A | 4/1960 | Wright |
| 3,183,050 | A | 5/1965 | Hudson |
| 3,322,477 | A | 5/1967 | Armijo |
| 3,627,395 | A | 12/1971 | Hoey |
| D231,139 | S | 4/1974 | Stahel, II |
| 3,807,826 | A | 4/1974 | Peckenpaugh |
| 3,890,890 | A | 6/1975 | Hennells |

(Continued)

FOREIGN PATENT DOCUMENTS

EP 0423956 5/1991

OTHER PUBLICATIONS

Precision Ball Bearing Slides—Soft Close 8400s Hardware Distributors Ltd. 2008, 2 pages.

*Primary Examiner* — Fenn Mathew
*Assistant Examiner* — Elizabeth Volz
(74) *Attorney, Agent, or Firm* — John D. Veldhuis-Kroeze; Westman, Champlin & Koehler, P.A.

(57) ABSTRACT

A waste receptacle has an outer cabinet housing and a waste or trash bag support frame that can be rotated about an upright axis to provide access to a bag held on the support frame. The support frame has a ring, on which a waste bag can be placed, spaced upwardly from the bottom of the support frame so that when the waste bag is full, it can be detached from the ring and dropped down for removal. A swivel assembly has a top portion secured to the bottom pan of the waste bag support frame, a lower portion secured to the bottom wall of the outer cabinet, and a ring of ball bearings which supports the top portion and the lower portion relative to each other such that the top portion and the lower portion can rotate relative to each other within the outer cabinet.

12 Claims, 9 Drawing Sheets

(56) References Cited

U.S. PATENT DOCUMENTS

| | | | |
|---|---|---|---|
| D242,595 | S | 12/1976 | De Lise et al. |
| 4,639,050 | A | 1/1987 | Neuhaus |
| 4,946,118 | A | 8/1990 | Hastings |
| 5,013,102 | A | 5/1991 | Loblein |
| 5,244,270 | A | 9/1993 | Parker |
| 5,588,358 | A | 12/1996 | Klepacki et al. |
| 5,901,872 | A | 5/1999 | Zollinhofer et al. |
| D416,658 | S | 11/1999 | Houry |
| D418,650 | S | 1/2000 | Neuhaus |
| D442,346 | S | 5/2001 | Prosa |
| 6,390,321 | B1 | 5/2002 | Wang |
| 8,132,872 | B2 | 3/2012 | Prosa |
| 2007/0024166 | A1 | 2/2007 | Sung |
| 2010/0219191 | A1 * | 9/2010 | Prosa ..... B65F 1/1436 220/495.06 |

* cited by examiner

WASTE RECEPTACLE

CROSS-REFERENCE TO RELATED APPLICATION

The present application is based on and claims the benefit of U.S. provisional patent application Ser. No. 61/828,926, filed May 30, 2013, the content of which is hereby incorporated by reference in its entirety.

FIELD

The present disclosure relates to a waste receptacle that has an exterior housing, and a waste bag support which can be rotated within the housing. When the waste bag support is rotated about a vertical axis, a bag can be accessed on the waste bag support.

BACKGROUND

Various trash bag holders have been advanced, as well as garbage containers that hold trash bags. Many of these have hinged doors that are openable by pushing them inwardly. There are other types of receptacles and receptacle covers that will pivot open.

Removing full trash or waste bags from the waste containers generally requires lifting off a cover or otherwise opening the entire top of the container or outer housing and then lifting the full bag up over the container top for removal. This is inconvenient, time consuming and can promote poor lifting practices.

The discussion above is merely provided for general background information and is not intended to be used as an aid in determining the scope of the claimed subject matter.

SUMMARY

The present disclosure provides a waste receptacle that utilizes a stationary outer housing or cabinet that compliments the interior decor of a building, and which has a rotatable trash or waste bag support frame mounted for rotation within the outer housing. The waste or trash bag support frame has a part cylindrical outer wall, and has a waste bag support ring or hoop on a back side of the wall. The waste bag support frame and the bag support ring or hoop can be rotated within the cabinet about an upright axis for removable of a full trash bag. The removal is done by releasing the bag from the ring, and dropping the bag down to the floor or ground. A clean trash bag can be replaced on the support ring. The waste bag support frame is maintained in place in the cabinet when in use, and an openable cover, lid, door or other openable and closeable access structure can be opened to permit the rotation of the waste bag support frame.

In one form of the disclosure having an openable lid or cover, the lid or cover is pivotally mounted above the part cylindrical wall to cover an access opening to the bag above the part cylindrical wall, which extends to the exterior of the cabinet. The bottom edge of the cover is part circular and mates with the top edge of the part cylindrical outer wall of the support frame.

In some embodiments, a cover has a hinge, and the cover hinge utilizes a pivot support that will provide damping as the cover is opened or closed.

The movement of rotating the bag support frame about an upright axis allows the part cylinder wall to be positioned so that the bag support ring and the bag are easy to access for removal and replacement. The top of the full bag can be dropped below the ring and removed without the need for lifting the full bag over the ring.

The unit is easily operated, compact, and reliable.

In some exemplary embodiments, a waste receptacle assembly having a front and a back includes an outer cabinet having a bottom wall and a top wall secured together by a rear cabinet wall extending between the bottom wall and the top wall, the rear cabinet wall positioned at the back of the waste receptacle assembly. A waste bag support frame, separate from the outer cabinet, comprises a bottom pan with a peripheral wall including an upright front wall or part cylinder wall at the front of the waste receptacle assembly and exposed on an exterior of the waste receptacle assembly opposite the rear cabinet wall of the outer cabinet and extending upwardly to a height below the top wall, the waste bag support frame also comprising a waste bag support ring supportively coupled to the upright front wall and extending rearwardly of the upright front wall, the waste bag support ring configured to support an upper end of a waste bag. The waste receptacle also includes a swivel assembly having a top portion secured to the bottom pan of the waste bag support frame, a lower portion secured to the bottom wall of the outer cabinet, and a ring of ball bearings which supports the top portion and the lower portion relative to each other such that the top portion and the lower portion can rotate relative to each other within the outer cabinet.

In some exemplary embodiments, the waste bag support frame and the swivel assembly are configured and arranged such that the waste bag support frame and the waste bag support ring are maintained within the outer cabinet between the top and bottom walls and are rotatable within the outer cabinet about an upright axis to facilitate removal of the waste bag, after the upright front wall is rotated toward the rear cabinet wall, by releasing the waste bag from the waste bag support ring such that the waste bag can be dropped below the waste bag support ring at the front of the waste receptacle assembly.

In some exemplary embodiments, the outer cabinet is a curved outer cabinet such that the rear cabinet wall is a curved rear cabinet wall, and the upright front wall of the waste bag support frame is a curved upright front wall.

In some exemplary embodiments, the upright front wall of the waste bag support frame is a part cylinder wall.

In some exemplary embodiments, the top wall has a cover attached thereto by hinged supports such that the cover is movable from a closed position to an open position, and the upright front wall of the waste bag support frame extends to a height below the cover when the cover is in the closed position.

In some exemplary embodiments, a bottom edge of the cover is shaped to mate with the curved upright front wall.

In some exemplary embodiments, the bottom pan is a circular shaped bottom pan, and the curved upright front wall is a semi-circular upright front wall which extends substantially 180 degrees around the circular bottom pan.

In some exemplary embodiments, the waste receptacle assembly further comprises a support flange mounted on the upper end of the upright front wall to supportively couple the waste bag support ring to the upright front wall.

In some exemplary embodiments, the swivel assembly is secured to the bottom pan of the waste bag support frame and to the bottom wall of the outer cabinet such that the top portion and the lower portion of the swivel assembly rotate relative to each other about an upright axis extending between the bottom wall and top wall of the outer cabinet.

In another exemplary embodiment of a waste receptacle assembly having a front and a back, the waste receptacle assembly comprises a curved outer cabinet having a bottom wall and a top wall secured together by a curved rear cabinet wall extending between the bottom wall and the top wall, the curved rear cabinet wall is positioned at the back of the waste receptacle assembly, and the top wall of the curved outer cabinet has a lid attached thereto by hinged supports such that the lid is movable from a closed position to an open position to put waste in the waste receptacle assembly. A waste bag support frame separate from the outer cabinet comprises a bottom pan with a peripheral wall including a part cylinder wall at the front of the waste receptacle assembly and exposed on an exterior of the waste receptacle assembly opposite the curved rear cabinet wall and extending upwardly to a height below the cover when the cover is in the closed position such that a bottom edge of the cover mates with the part cylinder wall. The waste bag support frame also comprises a waste bag support ring supportively coupled to the part cylinder wall and extending rearwardly of the part cylinder wall and configured to support an upper end of a waste bag. A swivel assembly is included having a top portion secured to the bottom pan of the waste bag support frame, a lower portion secured to the bottom wall of the outer cabinet, and a ring of ball bearings which supports the top portion and the lower portion relative to each other such that the top portion and the lower portion can rotate relative to each other within the outer cabinet. The waste bag support frame and the swivel assembly are configured and arranged such that the waste bag support frame and the waste bag support ring are maintained within the outer cabinet and are rotatable within the outer cabinet about an upright axis to facilitate removal of the waste bag, after the part cylinder wall is rotated toward a position in front of and proximate the rear cabinet wall, by releasing the waste bag from the waste bag support ring such that the waste bag can be dropped below the waste bag support ring at the front of the waste receptacle assembly.

It must be noted that the various features can be used in differing combinations in alternative embodiments.

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION OF ILLUSTRATIVE EMBODIMENTS

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
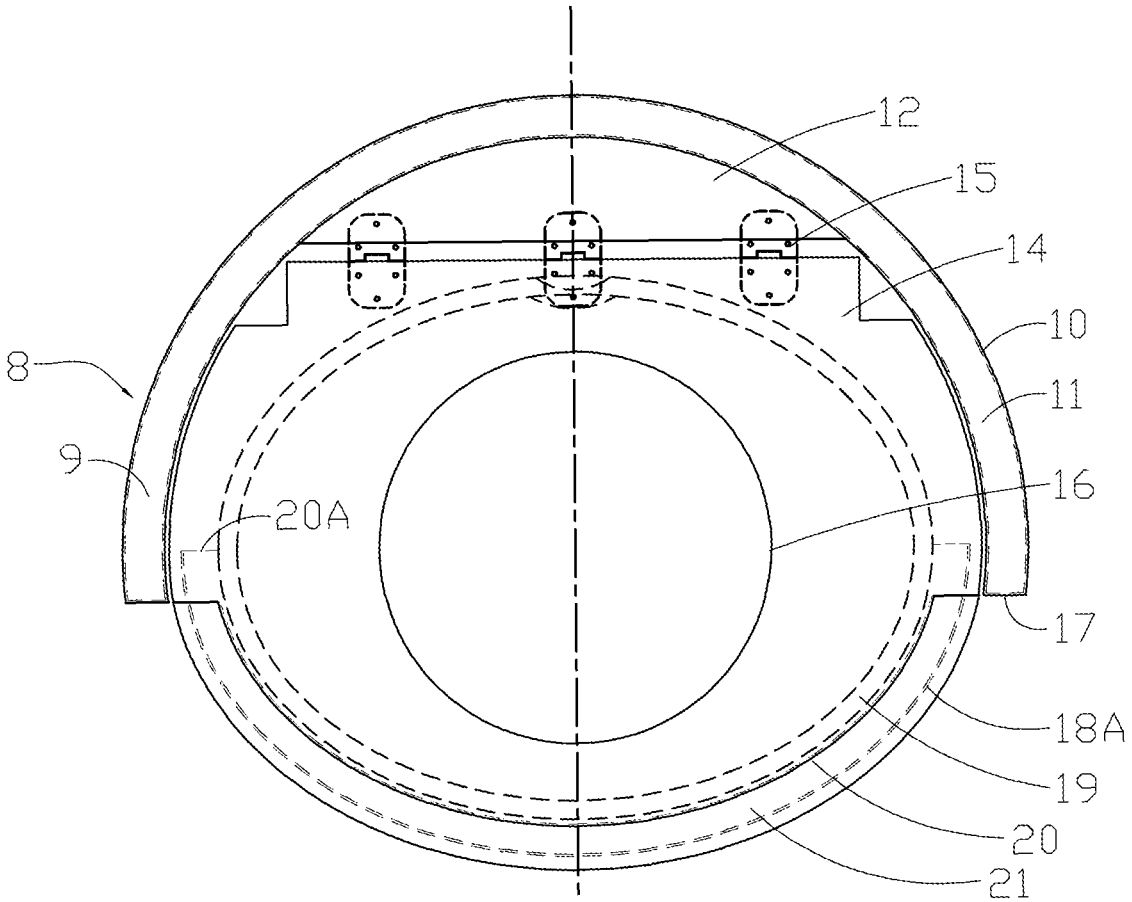
FIG. 1 is a top plan view of a waste receptacle and taken on line 1-1 in FIG. 3.
Figure 2:
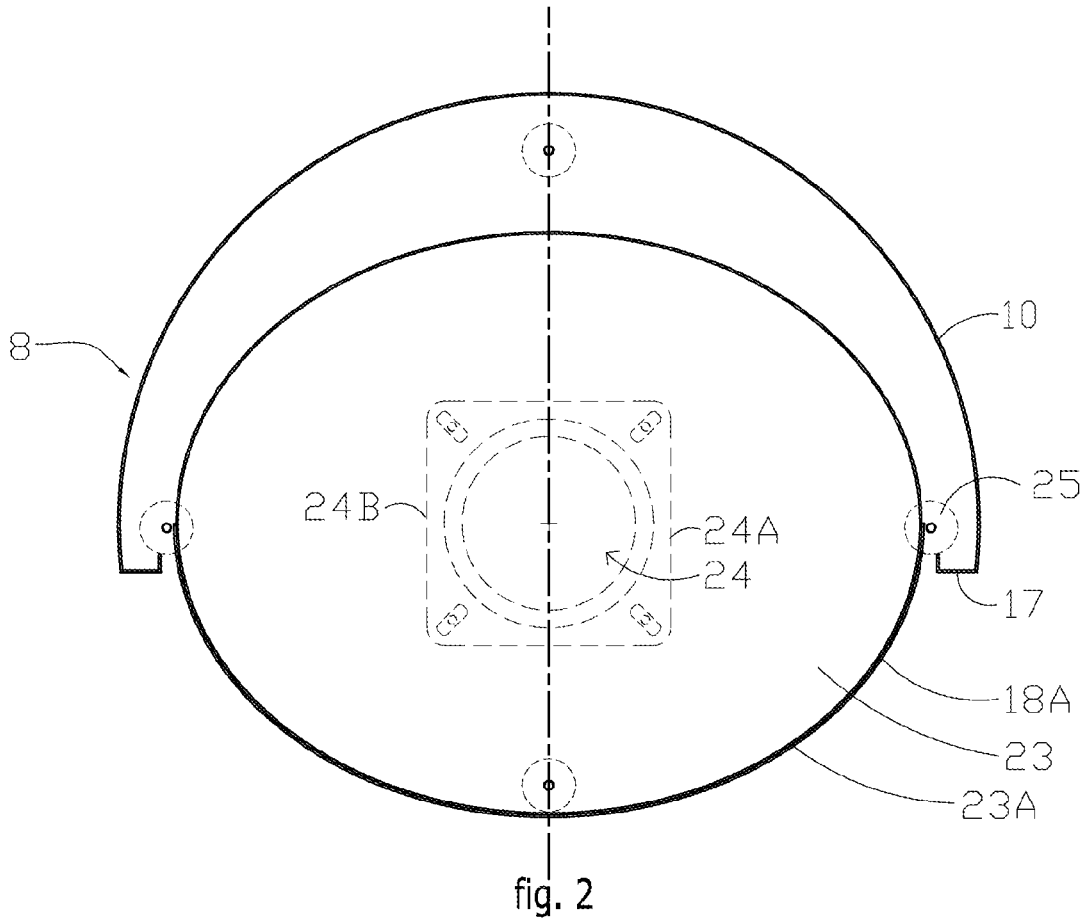
FIG. 2 is a sectional view taken as on line 2-2 in FIG. 3.
Figure 3:
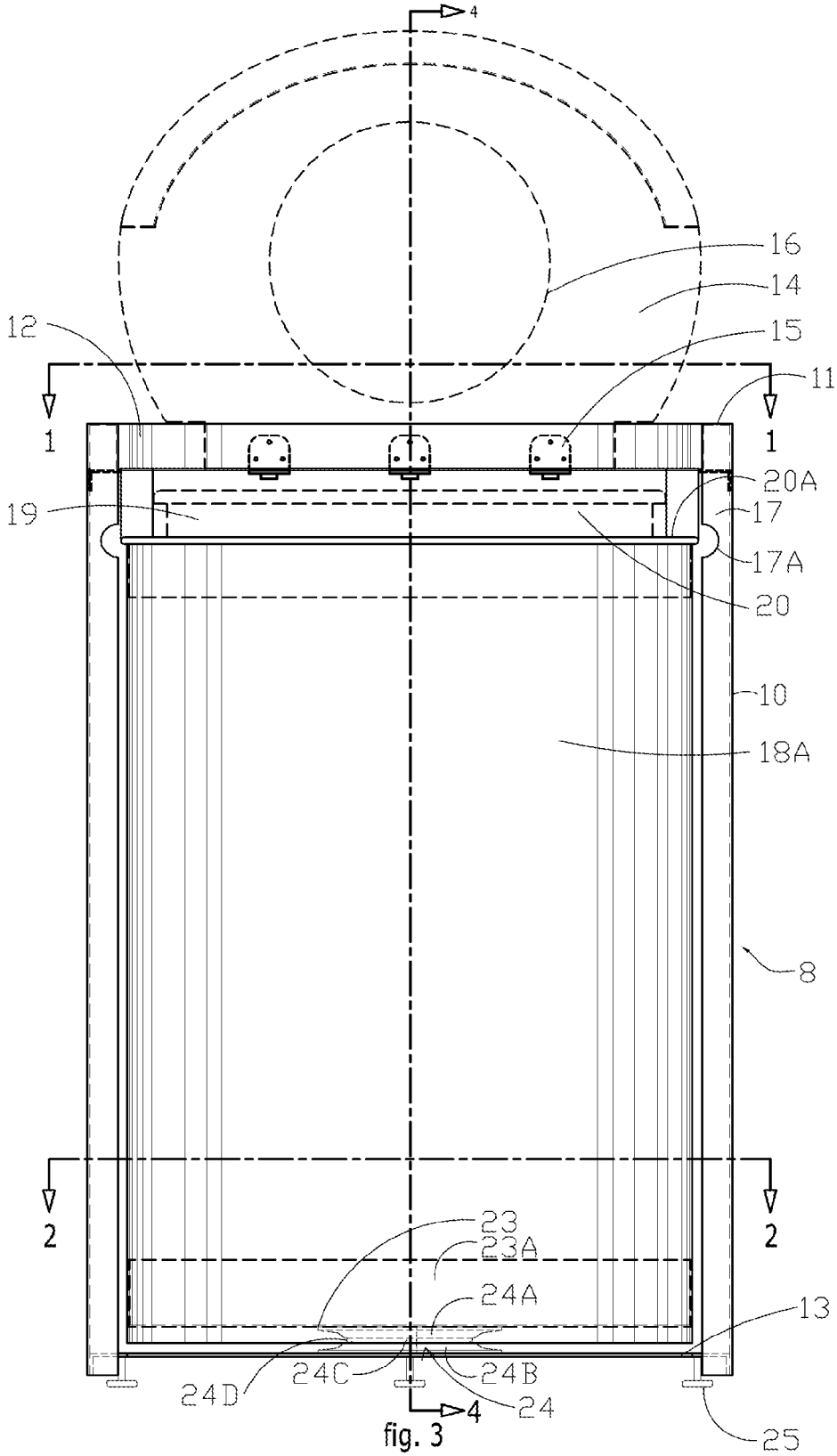
FIG. 3 is a front view of the waste receptacle of FIG. 1.

Disclosed embodiments provide examples of waste receptacles assemblies which include features making removal of a waste or trash bag easier and in such a way so as to promote healthier lifting techniques and improve waste bag removal ergonomics, while also reducing the area required for the waste receptacle and the corresponding process of changing the trash bag. This allows the waste receptacle assemblies to be positioned in more convenient locations, to take up less space, etc. Referring first to the views shown in FIGS. 1-5, a waste receptacle assembly of a first embodiment, indicated generally at 8, includes an curved outer cabinet 9 that has a bottom wall or support base 13 and a top wall 12 that are secured together to form a cabinet. Leveling feet 25 are provided at the perimeter of support base 13. (See e.g., FIGS. 2 and 3).

As shown the top wall 12 has a hinged cover or lid portion 14 attached thereto with suitable recessed hinges or hinged supports shown at 15. The hinged cover or lid 14 is mounted on suitable hinged supports 15, as will be explained, to move the cover or lid 14 from its closed position shown in solid lines in FIGS. 1 and 4 to its open position (illustrated in dashed or dotted line) shown in FIGS. 3 and 4. In the open position of the cover or lid 14, an opening is provided for access to a waste bag. The lid 14 has a horizontal flange 21 with a rolled outer edge, as shown for example in FIG. 4.

The hinged support 15 will prevent the cover or lid 14 from slamming down as the center of gravity of the cover goes over center as it is closed. A spring may be mounted to provide a return force to tend to close the open cover. The cover may be initially moved to be closed manually. A spring loaded detent to hold the cover or lid 14 open also can be used. In some exemplary embodiments, cover or lid 14 has an open portion or cutaway 16 (shown for example in FIG. 3), as well, so that with the cover or lid in the closed position there is an opening into which a person can drop trash through the opening.

A waste bag support or carrier frame 18 is made as a separate unit from the cabinet and the cover or lid 14. The bag support frame 18 includes a bottom or base metal, or other leak proof material, pan 23 with a peripheral wall 23A (See FIGS. 3 and 4) and a curved or semi-circular cross section upright front wall 18A. The wall 23A of pan 23 is secured to the upright front wall 18A. As can be seen, the front wall 18A extends upwardly and is a half of a right circular cylinder that extends substantially 180 degree around the circular pan 23. The front wall 18A also extends upwardly to a height below the cover 14 when the cover is closed, and the part-circular upper edge of wall 18A mates with the part circular bottom edge of the closed cover or lid. In other words, the lower edge of the cover or lid 14 is substantially the same size and shape as the upper edge of the part cylindrical front wall 18A. The side edges of the curved front wall 18A are spaced apart by a diameter of the pan 23.

Figure 4:
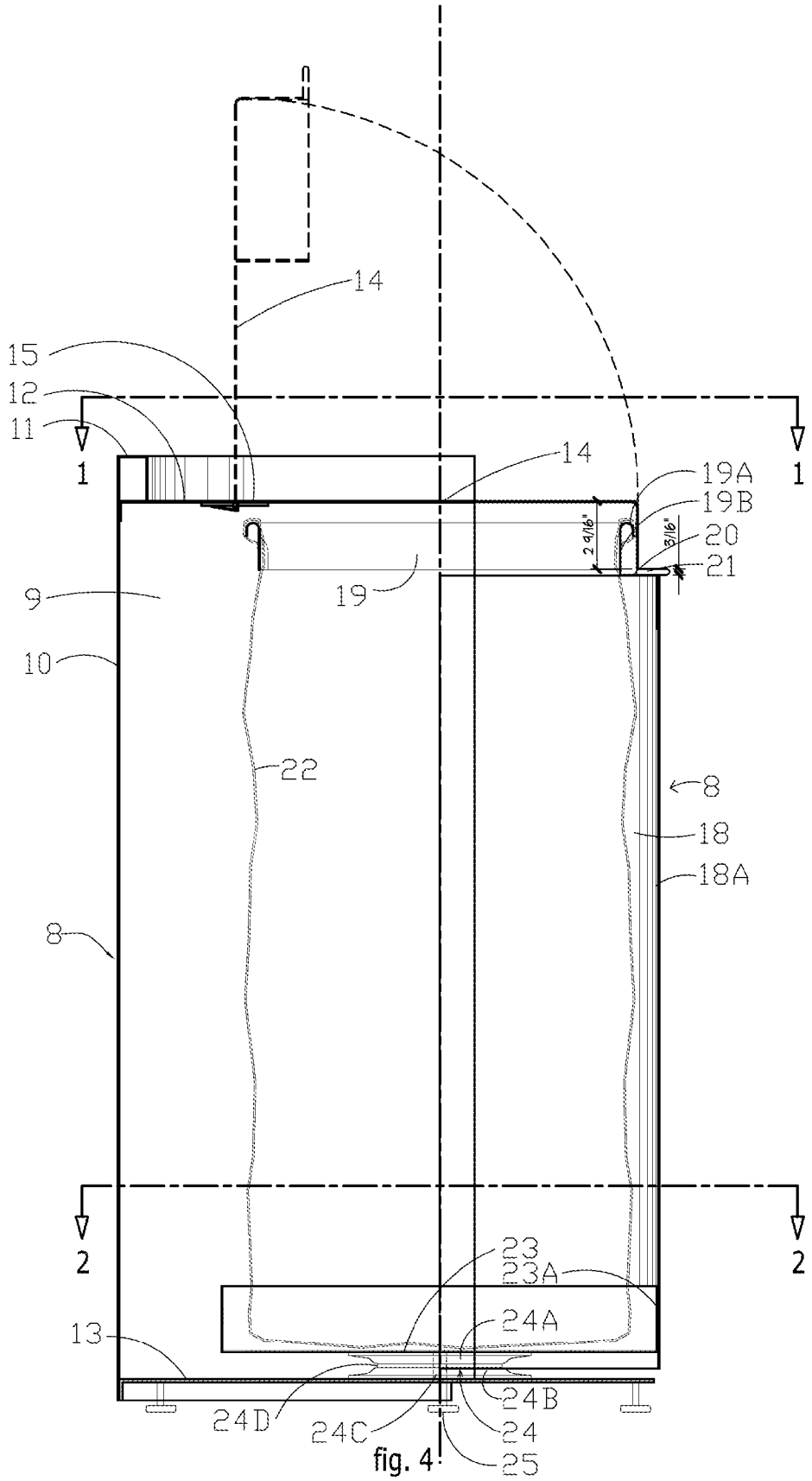
FIG. 4 is a sectional view taken as on line 4-4 in FIG. 3.

The front wall 18A forms a rigid upright support that in turn mounts a waste or trash bag support ring 19, which ring 19 is mounted on a metal support flange or top plate 20 mounted on the upper end of wall 18A. The top plate 20 is part circular and has ends 20A (see e.g., FIGS. 1 and 3). The support ring 19 extends horizontally outwardly from the backside of the front wall 18A. The ring 19 thus overlies the base pan 23. As can be seen in FIG. 4, a waste or trash bag 22 of thin conventional plastic can be supported on the support ring 19 by placing the top portion of the bag 22 on the interior of the ring 19 and folding the edge portion of the open upper portion of the bag over the ring generally as shown in FIG. 4.

The upright front wall 18A extends outwardly from the front of the cabinet edge 17. The diameter of the half cylinder front wall 18A is slightly less than the space between the outer curved cabinet 9 and the diameter plane between the edges of the half cylinder from the wall lies substantially along the front plane of the cabinet 9, but can rotate 360 degrees within the cabinet 9 shown in FIG. 5.

Figure 5:
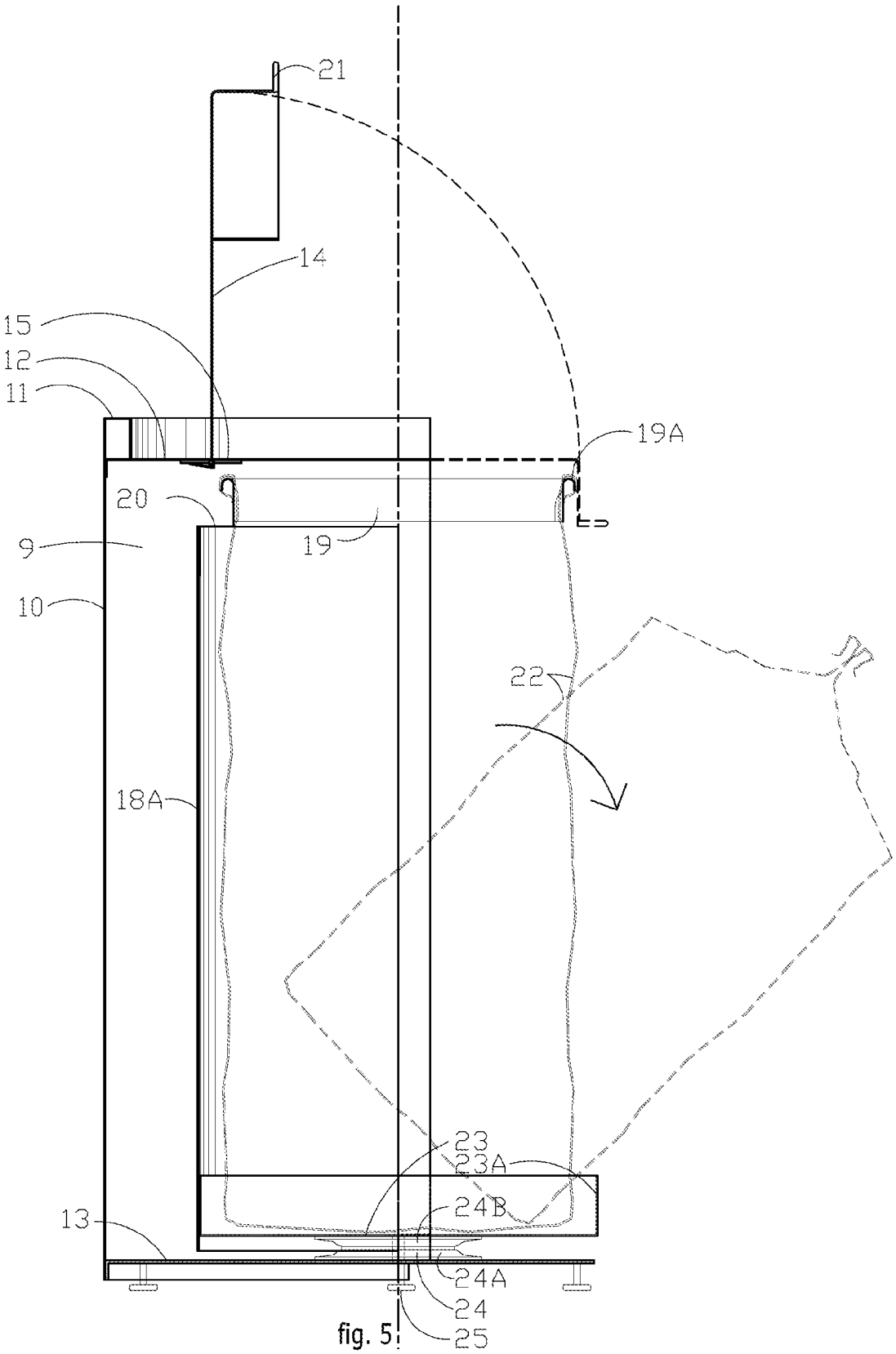
FIG. 5 is a side view of the waste receptacle of the disclosure showing a waste bag support frame in an open rotated position within outer cabinet housing.

Ring 19, as shown in FIGS. 4 and 5 has a rounded interior surface and a tubular top edge shape 19A that forms a recess 19B below the tube 19A, so that the top edge of the open end of the waste bag 22 can be folded over the top edge tube of ring 19 and then held in place in a suitable manner. The bag 22 can be of size so that it is supported on the base plate 23, when it is filled. The bag 22 can also be held in other ways, for example with clips that fit over the folded top part of the bag and which grip the support ring 19 or a rubber tension ring.

In FIG. 4, the base plate 23 of the waste bag support frame 18 is supported on a bar stool swivel assembly indicated at 24, The bar stool swivel assembly 24 includes a top portion 24A secured to the base plate 23 and a lower portion 24B that is secured to an bottom wall 13 to which the swivel is mounted. The two swivel portions 24A and 24B are supported relative to each other on a ring 24D of suitable ball bearings, in a normal manner, and a center post 24C holds the two swivel portions 24A and 24B so that they can rotate relative to each other. The barstool swivels are available from Hardware Distributors, Limited.

The base plate 23 can be made of sufficient strength so that it will support the forward curved wall 18A. The swivel assembly 24 can be a purchased assembly, that is a high load carrying device that will support the load of a large trash bag carried on the support ring at the top of the waste bag support frame 18, with adequate strength.

The rotatable swivel assembly 24 allows the support frame 18 to be rotated 360 degrees with an outer cabinet 9. When the support frame 18 is rotated 180 degrees and the cover or lid 14 is moved to its open position represented by dotted lines in the FIGs., the top of the trash bag held by the ring 19 is easily accessible through the opening above the wall 18A, and trash or waste can be removed as shown in FIG. 5. The cover 14 will be held open with the hinge 15 until the waste bag support frame is rotated 180 degrees to its original closed position with the waste bag inaccessible.

The cover 14 may be manually moved from its open position toward the closed position and as it pivots closed, the center of gravity of the cover goes over center so the cover will continue to close under gravity. A spring that exerts force to urge the cover toward its closed position also can be provided to initially start the closing movement of the cover. The spring can be a torsion spring or a tension spring acting between the cover and the cabinet, and effective for only an initial movement of the cover from its open position, or until the cover center of gravity goes over center.

Once a trash bag held by the ring 19 and the waste bag support frame 18 is full and needs to be emptied, the respective waste bag support frame is rotated within the cabinet. The bag support frame is then rotated so the full bag is exposed, for example as shown in FIG. 5, where the bag support frame has been rotated 180 degrees. By not requiring the waste bag support frame to be removed from within the cabinet to expose the full bag, significant space saving is achieved, allowing waste receptacle 8 to be utilized in locations which might otherwise not have sufficient space to allow for the waste receptacle waste bag to be removed.

The top of the trash bag can be loosened from the support ring 19 and the top of the bag dropped below the ring. Then the bag can be slid off the bottom pan 23 and removed without having to lift the loaded bag above the upper edge of an outer container. Lifting loaded waste or trash bags is required in conventional waste containers, and leads to strains and claims. A new bag can be installed, the bag support frame rotated back into its closed position.

In some exemplary embodiments, the pans 23 are made to catch liquids that may leak from a bag, as well as catch other debris that may fall alongside a bag held on ring 19. The pans can be of metal or plastic or other leak proof material.

Figure 6:
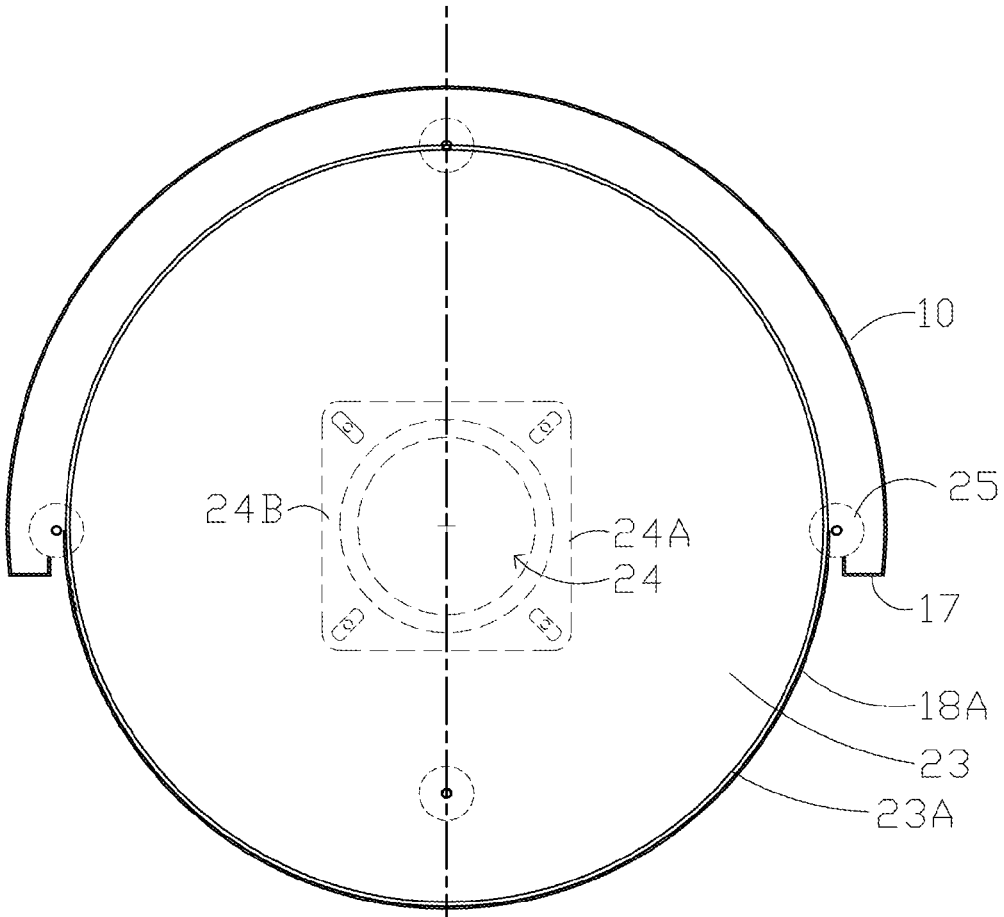
FIG. 6 is a top plan view of a further modified form of the waste receptacle.
Figure 7:
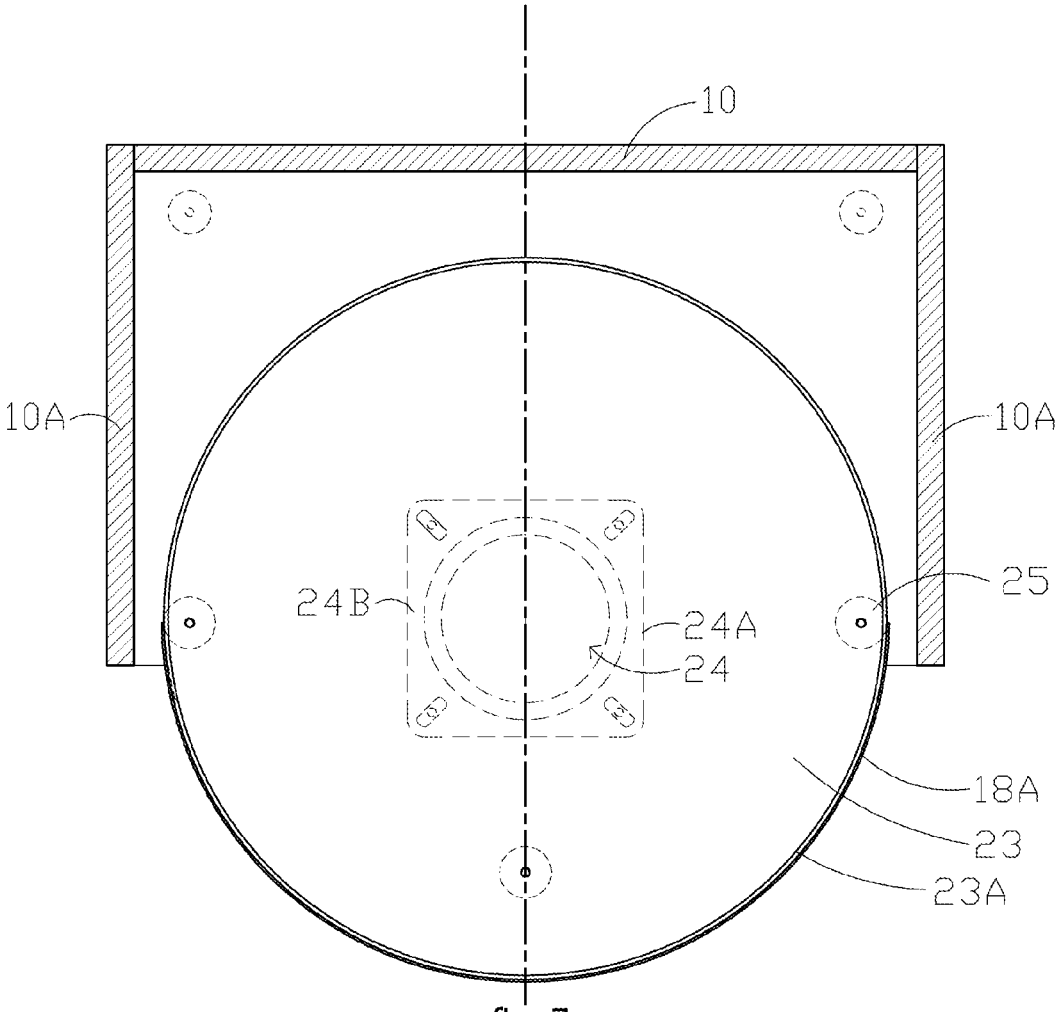
FIG. 7 is a top plan view of a further modified form of the waste receptacle.

FIGS. 6 and 7 disclose a different form of the assembly as shown in FIGS. 1-5. The same cabinet construction can be utilized. The same construction of the waste bag or receptacle frame can also be utilized, and the numbers in FIGS. 6 and 7, are the same as in the previous figures, show essentially the same parts.

In all forms of the disclosure, the waste bag is supported on a waste bag support frame that mates with and is movable by rotation partial into the cabinet. The waste bag support frame has a front wall that closes the cabinet front and the waste bag support frame can be rotated within the cabinet for ease of removing a loaded waste bag. The waste bag is easily attached and held in place and easily removed.

The curved front wall nests with the cabinet and forms a pleasing appearance. The cover shown is also easily operated and covers the opening to the trash bag when closed.

Figure 8:
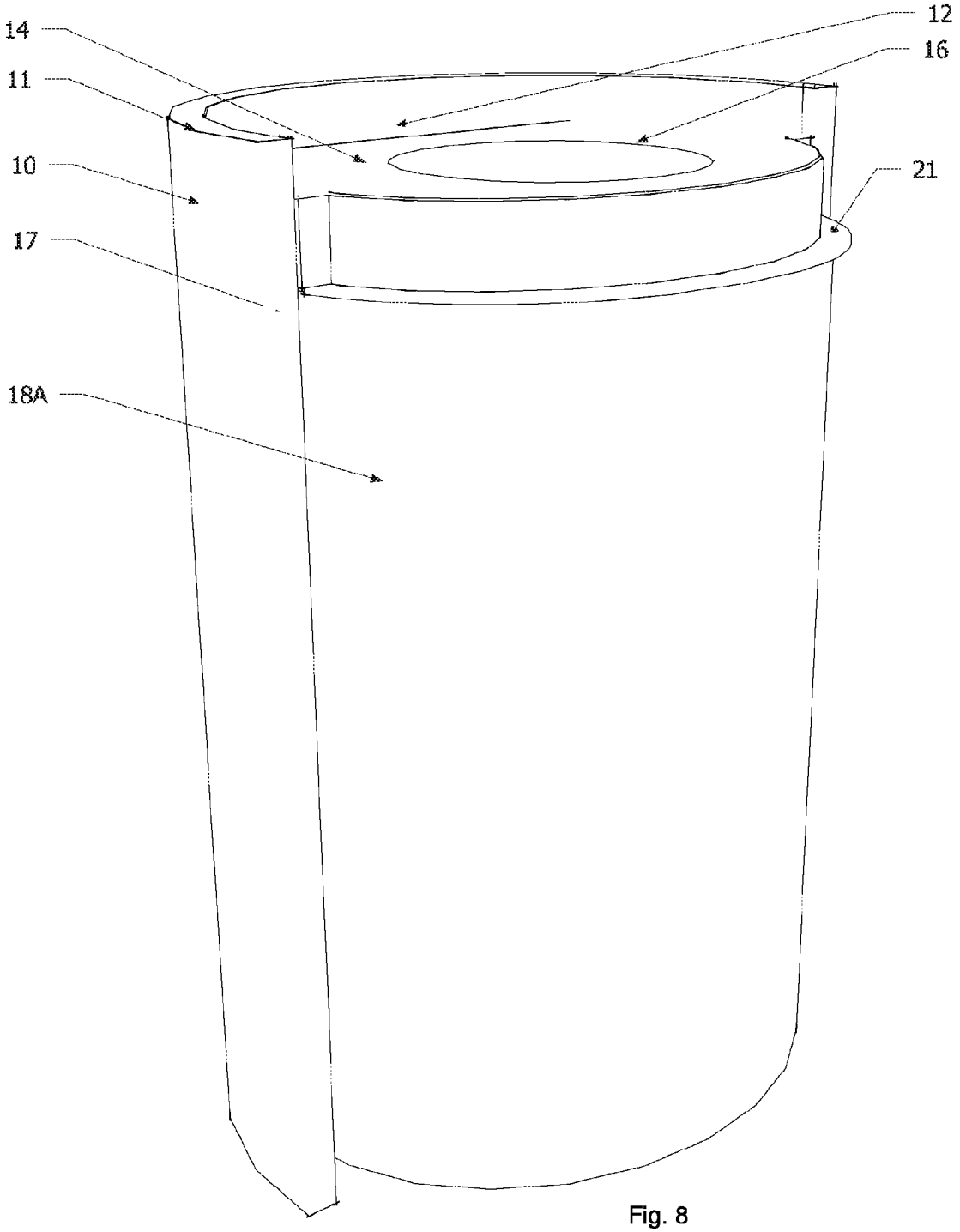
FIGS. 8 and 9 show perspective views of various embodiments of the waste receptacle.
Figure 9:
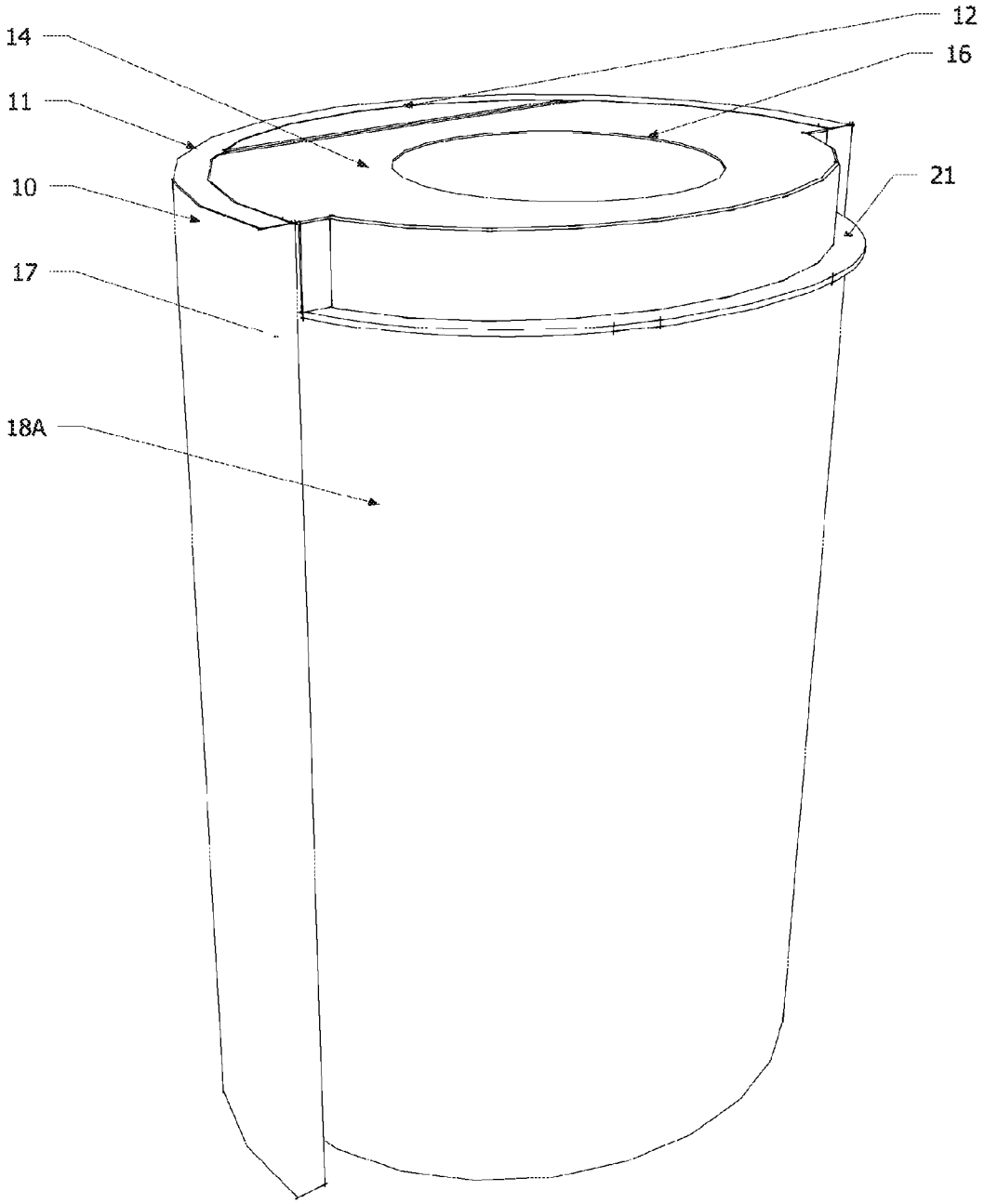

FIGS. 8 and 9 are perspective views of various embodiments of the waste receptacle 8. FIG. 8 shows a perspective view in which hemispherical wall section 11 extends above the cover or lid 14. FIG. 9 shows a flat top version in which either hemispherical wall 11 is eliminated or the cover or lid 14 lies in a same plane as an upper surface of hemispherical wall 11.

Although the present invention has been described with reference to preferred embodiments, workers skilled in the art will recognize that changes may be made in form and detail without departing from the spirit and scope of the invention.

What is claimed is:

1. A waste receptacle assembly having a front and a back, the waste receptacle assembly comprising:

an outer cabinet having a bottom wall and a top wall secured together by a rear cabinet wall extending between the bottom wall and the top wall, the rear cabinet wall positioned at the back of the waste receptacle assembly;

a waste bag support frame separate from the outer cabinet comprising a bottom pan with a peripheral wall including an upright front wall at the front of the waste receptacle assembly and exposed on an exterior of the waste receptacle assembly opposite the rear cabinet wall of the outer cabinet and extending upwardly to a height below the top wall, the waste bag support frame also comprising a waste bag support ring supportively coupled to the upright front wall and extending rearwardly of the upright front wall, the waste bag support ring configured to support an upper end of a waste bag;

a swivel assembly having a top portion secured to the bottom pan of the waste bag support frame, a lower portion secured to the bottom wall of the outer cabinet, and a ring of ball bearings which supports the top portion and the lower portion relative to each other such that the top portion and the lower portion can rotate relative to each other within the outer cabinet;

wherein the waste bag support frame and the swivel assembly are configured and arranged such that the waste bag support frame and the waste bag support ring are maintained within the outer cabinet between the top and bottom walls and are rotatable within the outer cabinet about an upright axis to facilitate removal of the waste bag, after the upright front wall is rotated toward the rear cabinet wall, by releasing the waste bag from the waste bag support ring such that the waste bag can be dropped below the waste bag support ring at the front of the waste receptacle assembly.

2. The waste receptacle assembly of claim 1, wherein the outer cabinet is a curved outer cabinet such that the rear cabinet wall is a curved rear cabinet wall, and wherein the upright front wall of the waste bag support frame is a curved upright front wall.

3. The waste receptacle assembly of claim 2, wherein the upright front wall of the waste bag support frame is a part cylinder wall.

4. The waste receptacle assembly of claim 2, wherein the top wall has a cover attached thereto by hinged supports such that the cover is movable from a closed position to an open position, and wherein the upright front wall of the waste bag support frame extends to a height below the cover when the cover is in the closed position.

5. The waste receptacle assembly of claim 4, wherein a bottom edge of the cover is shaped to mate with the curved upright front wall.

6. The waste receptacle assembly of claim 2, wherein the bottom pan is a circular shaped bottom pan, and wherein the curved upright front wall is a semi-circular upright front wall which extends substantially 180 degrees around the circular bottom pan.

7. The waste receptacle assembly of claim 6, and further comprising a support flange mounted on the upper end of the upright front wall to supportively couple the waste bag support ring to the upright front wall.

8. The waste receptacle assembly of claim 1, wherein the swivel assembly is secured to the bottom pan of the waste bag support frame and to the bottom wall of the outer cabinet such that the top portion and the lower portion of the swivel assembly rotate relative to each other about an upright axis extending between the bottom wall and top wall of the outer cabinet.

9. A waste receptacle assembly having a front and a back, the waste receptacle assembly comprising:

a curved outer cabinet having a bottom wall and a top wall secured together by a curved rear cabinet wall extending between the bottom wall and the top wall, the curved rear cabinet wall positioned at the back of the waste receptacle assembly, the top wall of the curved outer cabinet having a lid attached thereto by hinged supports such that the lid is movable from a closed position to an open position to put waste in the waste receptacle assembly;

a waste bag support frame separate from the outer cabinet and comprising a bottom pan with a peripheral wall including a part cylinder wall at the front of the waste receptacle assembly and exposed on an exterior of the waste receptacle assembly opposite the curved rear cabinet wall and extending upwardly to a height below the cover when the cover is in the closed position such that a bottom edge of the cover mates with the part cylinder wall, the waste bag support frame also comprising a waste bag support ring supportively coupled to the part cylinder wall and extending rearwardly of the part cylinder wall, the waste bag support ring configured to support an upper end of a waste bag;

a swivel assembly having a top portion secured directly to the bottom pan of the waste bag support frame, a lower portion secured to the bottom wall of the outer cabinet, and a ring of ball bearings which supports the top portion and the lower portion relative to each other such that the top portion and the lower portion can rotate relative to each other within the outer cabinet;

wherein the outer cabinet, the lid, the waste bag support frame and the swivel assembly are configured and arranged such that the waste bag support frame and the waste bag support ring are fully maintained within the outer cabinet and are rotatable within the outer cabinet about an upright axis to facilitate removal of the waste bag, after the part cylinder wall is rotated toward a position in front of and proximate the rear cabinet wall, by releasing the waste bag from the waste bag support ring such that the waste bag can be dropped below the waste bag support ring at the front of the waste receptacle assembly.

10. The waste receptacle assembly of claim 9, wherein the bottom pan is a circular shaped bottom pan, and wherein the part cylinder wall extends substantially 180 degrees around the circular bottom pan.

11. The waste receptacle assembly of claim 10, and further comprising a support flange mounted on the upper end of the part cylinder wall to supportively couple the waste bag support ring to the part cylinder wall.

12. The waste receptacle assembly of claim 11, wherein the swivel assembly is secured to the bottom pan of the waste bag support frame and to the bottom wall of the outer cabinet such that the top portion and the lower portion of the swivel assembly rotate relative to each other about an upright axis extending between the bottom wall and top wall of the outer cabinet.

* * * * *